US011174118B2

(12) United States Patent
Tsuchiya

(10) Patent No.: US 11,174,118 B2
(45) Date of Patent: Nov. 16, 2021

(54) PAPER STACKING DEVICE AND IMAGE FORMING SYSTEM

(71) Applicant: KONICA MINOLTA, INC., Tokyo (JP)

(72) Inventor: Tsuyoshi Tsuchiya, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 93 days.

(21) Appl. No.: 16/682,563

(22) Filed: Nov. 13, 2019

(65) Prior Publication Data

US 2020/0156895 A1 May 21, 2020

(30) Foreign Application Priority Data

Nov. 21, 2018 (JP) ..... JP2018-218546

(51) Int. Cl.
*B65H 31/10* (2006.01)
*B65H 31/26* (2006.01)
*B65H 31/34* (2006.01)

(52) U.S. Cl.
CPC ..... *B65H 31/10* (2013.01); *B65H 31/26* (2013.01); *B65H 31/34* (2013.01); *B65H 2511/10* (2013.01); *B65H 2801/27* (2013.01)

(58) Field of Classification Search
CPC ..... B65H 31/10; B65H 31/26; B65H 31/34; B65H 9/101; B65H 2301/3613; B65H 2511/10; B65H 2801/27
USPC ..... 271/207
See application file for complete search history.

(56) References Cited

U.S. PATENT DOCUMENTS 4,938,657 A * 7/1990 Benson ..... B65G 57/06 271/188
5,451,044 A * 9/1995 Nakayama ..... B65H 29/26 271/189
6,330,999 B2 * 12/2001 Coombs ..... B65H 31/3009 270/58.18

(Continued)

FOREIGN PATENT DOCUMENTS

JP 06-329327 A 11/1994
JP 09-002717 A 1/1997

(Continued)

OTHER PUBLICATIONS

Notice of Allowance issued in corresponding U.S. Appl. No. 16/682,414, dated Jun. 15, 2021 (12 pages).

*Primary Examiner* — Leslie A Nicholson, III
(74) *Attorney, Agent, or Firm* — Buchanan Ingersoll & Rooney PC

(57) ABSTRACT

A paper stacking device includes: a stacker on which paper is stacked; a paper ejector that ejects the paper toward the stacker; an aligning plate that is provided on a side of the paper stacked on the stacker, and aligns a side end of the paper; and a paper floating member that is provided in the aligning plate, and supports, from below, the side end of the paper ejected from the paper ejector, wherein the paper floating member is switched, in conjunction with a movement in upward and downward directions of the aligning plate, between: a paper floating position that advances from a side of the side end of the paper to an ejection route of the paper, and causes the paper ejected from the paper ejector to float from uppermost paper stacked on the stacker; and a retreat position that retreats from the ejection route.

8 Claims, 8 Drawing Sheets

(56) References Cited

U.S. PATENT DOCUMENTS

| | | | | |
|---|---|---|---|---|
| 6,450,934 | B1 * | 9/2002 | Coombs | B42C 1/12 270/58.12 |
| 7,758,033 | B2 * | 7/2010 | Terao | B65H 31/3081 270/58.02 |
| 7,896,333 | B2 * | 3/2011 | Taki | B42C 1/125 270/58.12 |
| 8,162,307 | B2 * | 4/2012 | Taki | B65H 33/08 270/58.12 |
| 9,085,436 | B2 | 7/2015 | Suzuki | |
| 2008/0230984 | A1 | 9/2008 | Kobayashi | |
| 2012/0026263 | A1 | 2/2012 | Chiwata | |
| 2013/0228965 | A1 | 9/2013 | Hoshino | |

FOREIGN PATENT DOCUMENTS

| | | | |
|---|---|---|---|
| JP | 2011084359 | A | 4/2011 |
| JP | 2013-010577 | A | 1/2013 |
| JP | 2014040326 | A | 3/2014 |
| JP | 2014047047 | A | 3/2014 |
| JP | 2014105081 | A | 6/2014 |

* cited by examiner

FIG. 9

| BASIS WEIGHT | LARGE | MEDIUM | SMALL |
|---|---|---|---|
| PAPER FLOATING POSITION | Pb3 | Pb2 | Pb1 |
| SIZE | LARGE | MEDIUM | SMALL |
| PAPER FLOATING POSITION | Pb3 | Pb2 | Pb1 |
| IMAGE INFORMATION | LARGE | MEDIUM | SMALL |
| PAPER FLOATING POSITION | Pb3 | Pb2 | Pb1 |

PAPER STACKING DEVICE AND IMAGE FORMING SYSTEM

The entire disclosure of Japanese patent Application No. 2018-218546, filed on Nov. 21, 2018, is incorporated herein by reference in its entirety.

BACKGROUND

Technological Field

The present invention relates to a paper stacking device and an image forming system.

Description of the Related Art

An image forming apparatus or a paper processing apparatus includes a paper stacking device that stacks paper on which prescribed processing has been performed. The paper stacking device includes an ejected paper tray (a stacker) on which paper is stacked, and a paper ejecting roller (a paper ejector) that ejects paper toward the ejected paper tray. The paper ejected from the paper ejecting roller is sequentially staked on the ejected paper tray. Meanwhile, in this type of paper stacking device, paper ejected from a paper ejecting roller is stuck onto paper stacked on an ejected paper tray, and in particular, uppermost paper, in some cases. In these cases, a front end of the ejected paper buckles, paper that has already been stacked is pushed out and drops from the ejected paper tray, or misalignment in a paper ejection direction occurs.

For example, JP 2014-40326 A, JP 2014-105081 A, and JP 2014-47047 A disclose a method for disposing a fan on an outer side (a side) in a paper width direction of paper and blowing air to side ends of the paper that are located on both sides in the paper width direction so as to suppress the sticking of paper. In addition, for example, JP 2011-84359 A discloses a configuration in which a holder is included that extends along a paper ejection direction and the holder is rotatable with a shaft member that extends in a paper width direction as a center. In JP 2011-84359 A, the holder can rotationally move upward to a first position in which the holder holds paper ejected from a paper ejecting roller, and can rotationally move downward from the first position to a second position in which the holder does not hold the paper.

However, the posture or behavior of paper ejected from a paper ejecting roller changes according to the basis weight of the paper, or the like. Therefore, techniques disclosed in JP 2014-40326 A, JP 2014-105081 A, and JP 2014-47047 A have a problem in which it is difficult to appropriately adjust air volume. For example, an excessively weak flow of air fails to cause paper to float. In contrast, an excessively strong flow of air raises paper, and the misalignment of paper occurs.

In addition, in a technique disclosed in JP 2011-84359 A, the holder is rotationally moved in upward and downward directions with a rotary shaft along the paper width direction as a center, and therefore the following inconvenience occurs according to the length of the holder. For example, in a case where the holder is long, it takes longer time to retreat from the first position to the second position, and there is a possibility of a reduction in productivity. In contrast, in a case where the holder is short, a front-end side of paper having a large size in the paper ejection direction hangs down from the holder, and there is a possibility of the occurrence of sticking onto uppermost paper.

SUMMARY

The present invention has been made in view of the circumstances described above, and it is an object of the present invention to provide a paper stacking device and an image forming system that are capable of stacking paper with satisfactory productivity while suppressing the sticking of ejected paper.

To achieve the abovementioned object, according to an aspect of the present invention, a paper stacking device reflecting one aspect of the present invention comprises: a stacker on which paper is stacked; a paper ejector that ejects the paper toward the stacker, an aligning plate that is provided on a side of the paper stacked on the stacker, and aligns a side end of the paper, and a paper floating member that is provided in the aligning plate, and supports, from below, the side end of the paper ejected from the paper ejector, wherein the paper floating member is switched, in conjunction with a movement in upward and downward directions of the aligning plate, between: a paper floating position that advances from a side of the side end of the paper to an ejection route of the paper, and causes the paper ejected from the paper ejector to float from uppermost paper stacked on the stacker, and a retreat position that retreats from the ejection route.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 9 is an explanatory diagram illustrating a relationship between information relating to paper and a paper floating position.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
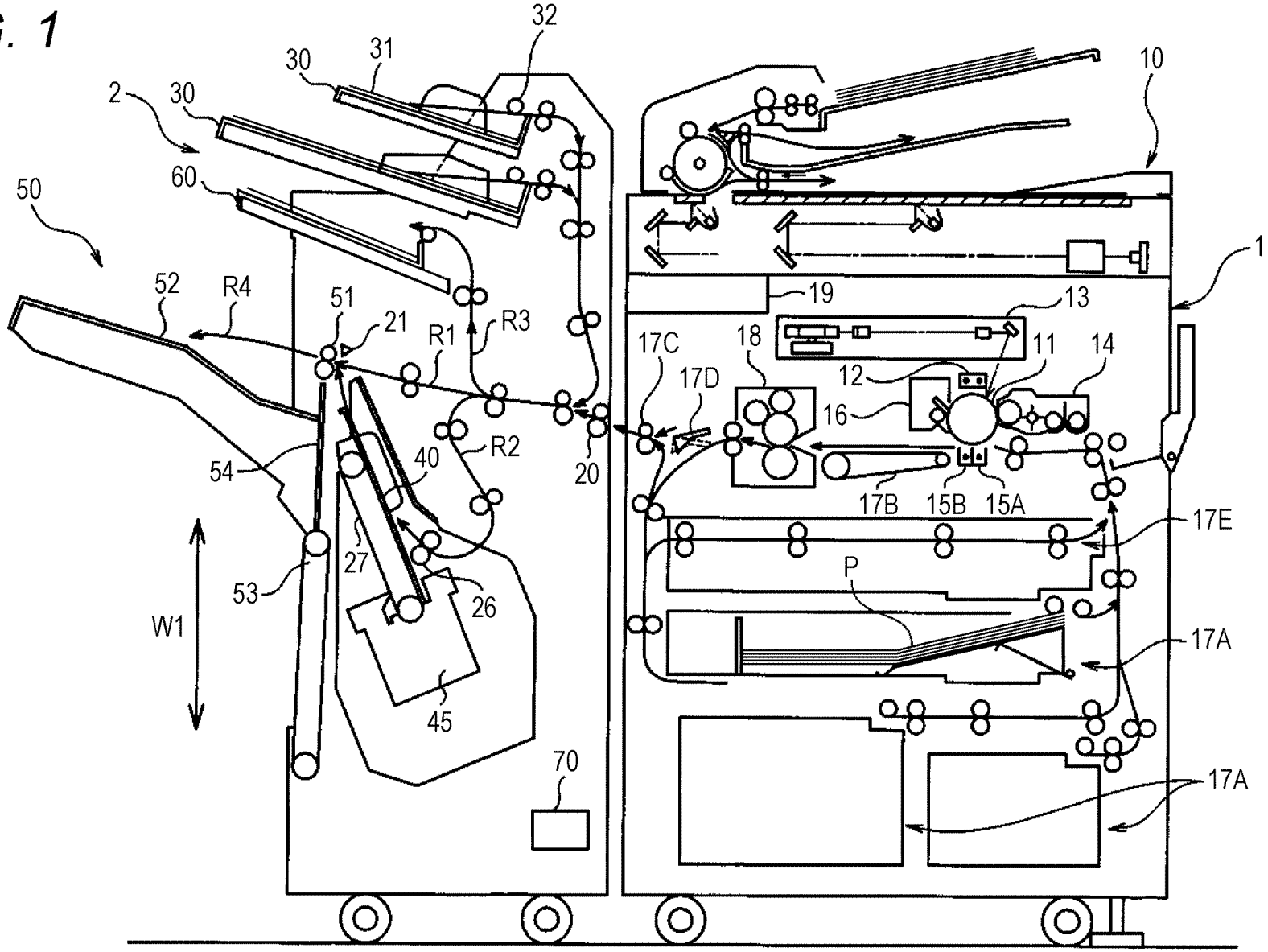
FIG. 1 is a configuration diagram schematically illustrating an image forming system according to a first embodiment.

FIG. 1 is a configuration diagram schematically illustrating an image forming system according to the present embodiment. The image forming system according to the present embodiment includes an image forming apparatus 1 and a postprocessing apparatus 2.

The image forming apparatus 1 is an electrophotographic image forming system such as a copying machine, and the image forming apparatus 1 forms an image on paper P on the basis of image data. The image forming apparatus 1 includes an original reader 10, a photoreceptor 11, an electrifier 12, an image exposure unit 13, a developing unit 14, a transfer unit 15A, a separator 15B, a cleaning device 16, a fixing device 18, and an image formation controller 19.

The original reader 10 is disposed in an upper portion of a housing of the image forming apparatus 1, and includes an automatic original delivering unit that automatically moves an original in reading an image. This original reader 10 reads an image formed on the original, and outputs a prescribed image signal. A/D conversion is performed on the output image signal, so that image data is generated.

An image reading controller (not illustrated) included in the original reader 10 performs processing, such as shading correction, dither processing, or compression, on the image data, and outputs data obtained as a result of this processing as final image data to the image formation controller 19. The image formation controller 19 may obtain image data from the original reader 10, or may obtain image data from a personal computer that is connected to the image forming system, or another image forming system.

A surface of the photoreceptor 11 is uniformly electrified by the electrifier 12. The image exposure unit 13 scans and exposes the surface of the photoreceptor 11 to a laser beam on the basis of output information that has been output from the image formation controller 19 on the basis of the image data. By doing this, a latent image is formed on the surface of the photoreceptor 11. The developing unit 14 develops the latent image with toner, and forms an image (a toner image) on the surface of the photoreceptor 11.

Paper P stored in a paper tray 17A is fed to the transfer unit 15A. The transfer unit 15A transfers, onto the paper P, the image on the surface of the photoreceptor 11. The separator 15B separates the paper P onto which the image has been transferred from the photoreceptor 11. The cleaning device 16 removes toner that remains on the surface of the photoreceptor 11 after the image has been transferred onto the paper P. An intermediate conveyor 17B conveys the separated paper P to the fixing device 18.

The fixing device 18 performs fixing processing for fixing the image onto the paper P by heating and pressing. A first paper ejecting roller 17C ejects (feeds), to the postprocessing apparatus 2, the paper P on which fixing processing has been performed.

On the other hand, in a case where an image is formed on both sides of the paper P, a conveyance direction of the paper P on which fixing processing has been performed by the fixing device 18 is switched from a direction toward the first paper ejecting roller 17C to a downward direction (a direction toward a reverse conveyor 17E) by a conveyance route switching plate 17D. The reverse conveyor 17E switches back the paper P so as to reverse a front surface and a reverse surface of the paper P, and conveys the paper P the transfer unit 15A.

The image formation controller 19 controls the image forming apparatus 1. As the image formation controller 19, a microcomputer that principally includes a CPU, a ROM, a RAM, and an I/O interface can be used. The CPU executes various programs (a processor). The ROM stores the various programs to be executed by the CPU in the form of a program code that can be read by the CPU. The ROM also stores data that is used to execute the programs. The RAM is a memory serving as a working storage area. When the programs and the data that have been stored in the ROM are read by the CPU, the programs and the data are developed on the RAM. Then the CPU performs various types of processing on the basis of the programs and the data that have been developed on the RAM.

The postprocessing apparatus 2 is disposed on a downstream side of the image forming apparatus 1 in a paper conveyance direction so as to be adjacent to the image forming apparatus 1, and the postprocessing apparatus 2 is a paper processing apparatus that performs postprocessing on paper P ejected from the image forming apparatus 1. In the present embodiment, the postprocessing apparatus 2 performs staple processing (binding processing), and stated another way, processing for superimposing plural sheets of paper P and binding the plural sheets of paper P by using a staple (a binding member). The postprocessing apparatus 2 principally includes an introducing unit 20, an intermediate stacker 40, a staple unit 45, a paper stacking device 50, and a paper processing controller 70.

The introducing unit 20 introduces paper P ejected from the image forming apparatus 1 into the postprocessing apparatus 2. The position of the introducing unit 20 has been set to correspond to the position of the first paper ejecting roller 17C of the image forming apparatus 1.

In order to introduce, into the postprocessing apparatus 2, paper P other than paper P ejected from the image forming apparatus 1, the postprocessing apparatus 2 is provided with a paper feeding unit 30. The paper feeding unit 30 includes a paper feeding tray 31 and a paper delivering unit 32. When paper P placed on the paper feeding tray 31 is delivered by the paper delivering unit 32, the paper P is conveyed through a prescribed conveyance route, and joins a conveyance route on a downstream side of the introducing unit 20.

The outline of a conveyance route of paper P in the postprocessing apparatus 2 is described. The conveyance route on the downstream side of the introducing unit 20 branches into a first conveyance route R1, a second conveyance route R2, and a third conveyance route R3. Paper P introduced from the introducing unit 20 or the paper feeding unit 30 is delivered to any of the conveyance routes R1 to R3 according to the switching of a switching gate (not illustrated). In a case where staple processing is not performed and paper P is ejected to a tray outside the apparatus, the switching gate is set to the first conveyance route R1 or the third conveyance route R3. In contrast, in a case where staple processing is performed, the switching gate is set to the second conveyance route R2.

The first conveyance route R1 is a route through which no processing is performed on introduced paper P and the introduced paper P is conveyed to the paper stacking device 50 with no change. On the first conveyance route R1, a conveyance roller that conveys paper P, and the like are disposed.

The second conveyance route R2 is a route through which introduced paper P is conveyed to the paper stacking device 50 via the intermediate stacker 40. On the second conveyance route R2, a conveyance roller that conveys paper P, a stacker paper ejecting roller 26, a conveyance belt 27, and the like are disposed.

The stacker paper ejecting roller 26 is disposed in a position facing a paper placement surface of the intermediate stacker 40, and the stacker paper ejecting roller 26 ejects, to the intermediate stacker 40, paper P that has been conveyed through the second conveyance route R2. The conveyance belt 27 conveys, to the paper stacking device 50, a paper bundle placed on the intermediate stacker 40, and stated another way, plural sheets of paper P that have been bound with a staple.

The intermediate stacker 40 sequentially stacks paper P ejected from the stacker paper ejecting roller 26 such that staple processing will be performed by the staple unit 45. The intermediate stacker 40 is disposed in such a way that a front end of paper P placed on the intermediate stacker 40 faces more upward than a rear end of the paper P. When the paper P ejected from the stacker paper ejecting roller 26 drops onto the intermediate stacker 40, the paper P slides down on the intermediate stacker 40, and stops by the rear end of the paper P abutting onto a rear-end guide plate (not illustrated).

The staple unit 45 includes a stapler that drives a staple, and a clincher that clinches a tip of the staple along paper P. This staple unit 45 performs staple processing on plural sheets of paper P stacked on the intermediate stacker 40 by stapling the plural sheets of paper P in a predetermined position and a predetermined orientation. For example, the staple unit 45 performs side stitching for stapling a rear end of paper P.

The third conveyance route R3 is a route through which introduced paper P is conveyed to a sub tray 60. On the third conveyance route R3, a conveyance roller that conveys paper P is disposed. The sub tray 60 is disposed in an upper portion outside the apparatus. A small number of sheets of paper can be stacked on the sub tray 60, and therefore the sub tray 60 is used in the ejection of a small number of sheets of special paper P such as thick paper.

Figure 2:
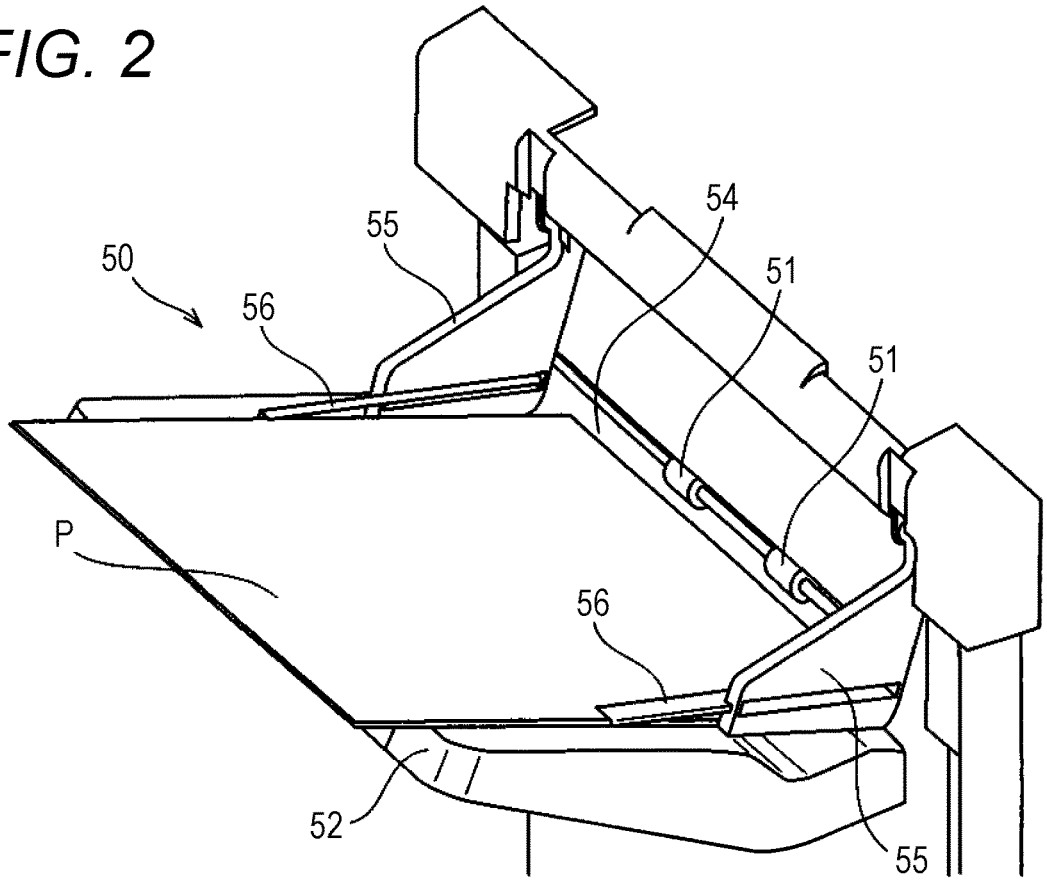
FIG. 2 is a perspective view illustrating an enlarged view of a principal portion of a paper stacking device.
Figure 3:
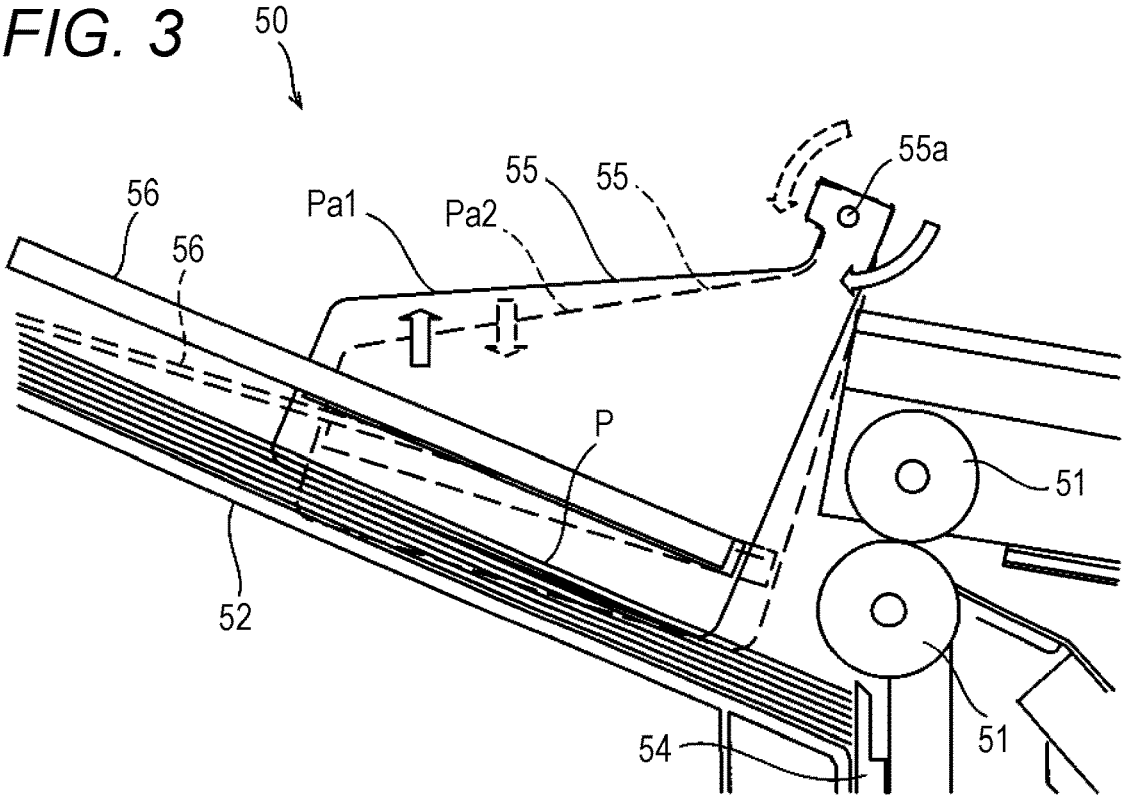
FIG. 3 is a sectional view illustrating an enlarged view of a principal portion of the paper stacking device.

FIG. 2 is a perspective view illustrating an enlarged view of a principal portion of the paper stacking device 50, and FIG. 3 is a sectional view illustrating an enlarged view of a principal portion of the paper stacking device 50. The paper stacking device 50 is a device that ejects and stacks paper P conveyed inside the postprocessing apparatus 2. The paper stacking device 50 principally includes a second paper ejecting roller 51, an ejected paper tray 52, an elevating/lowering mechanism 53 (see FIG. 1), a bumper plate 54, side-end aligning plates 55, and paper floating members 56.

The second paper ejecting roller 51 is located at the ends of the first conveyance route R1 and the second conveyance route R2, and ejects, toward the ejected paper tray 52, paper P conveyed through the respective conveyance routes R1 and R2. Herein, a front end and a rear end of paper P in the paper stacking device 50 are defined by using, as a reference, a paper ejection direction at the time of ejection from the second paper ejecting roller 51.

The ejected paper tray 52 is a tray on which paper P ejected from the second paper ejecting roller 51 is stacked. The ejected paper tray 52 can be elevated or lowered along a paper stacking direction (upward and downward directions) W1 (see FIG. 1) by the elevating/lowering mechanism 53. The elevating/lowering mechanism 53 is controlled by the paper processing controller 70 in such a way that uppermost paper P stacked on the ejected paper tray 52 maintains a prescribed height.

The ejected paper tray 52 has an inclined shape in such a way that a side of a front end of paper P stacked on the ejected paper tray 52 faces more upward than a side of a rear end of the paper P. The bumper plate 54 having a vertical wall shape is provided on the side of the rear end of the paper P in the ejected paper tray 52. This bumper plate 54 has a function of aligning paper P stacked on the ejected paper tray 52 by a rear end of the paper P bumping the bumper plate 54.

The side-end aligning plates 55 are members that align side ends of paper P ejected on the ejected paper tray 52, and stated another way, ends of the paper P that are located on both sides in a paper width direction (a direction orthogonal to the paper ejection direction). These side-end aligning plates 55 are respectively disposed on sides of paper P ejected from the second paper ejecting roller 51, and stated another way, on outer sides in the paper width direction, with the paper P as a center. Therefore, an ejection route R4 (see FIG. 1) of the paper P ejected from the second paper ejecting roller 51 is located between a pair of side-end aligning plates 55. An individual side-end aligning plate 55 is attached to a rotary shaft 55*a* that extends along the paper width direction.

Each of the pair of side-end aligning plates 55 is connected to a first power mechanism (not illustrated) such as an electric motor or a gear, and receives power from the first power mechanism so as to be able to swing along the paper width direction. The positions of the pair of side-end aligning plates 55 are set according to the width (size) of paper P ejected from the second paper ejecting roller 51, and the pair of side-end aligning plates 55 is disposed near side ends of the paper P ejected from the second paper ejecting roller 51. When paper P ejected from the second paper ejecting roller 51 is stacked on the ejected paper tray 52, the pair of side-end aligning plates 55 moves in the paper width direction and sandwiches the paper P from both sides so as to align side ends of the paper P (a paper alignment operation).

In addition, each of the pair of side-end aligning plates 55 is connected to a second power mechanism (not illustrated) such as an electric motor or a gear, and receives power from the second power mechanism so as to be able to rotationally move with the rotary shaft 55*a* as a center. An individual side-end aligning plate 55 rotationally moves with the rotary shaft 55*a* as a center so as to move in upward and downward directions. Specifically, as illustrated in FIG. 3, the side-end aligning plate 55 rotationally moves clockwise, so that the side-end aligning plate 55 moves upward (see a solid arrow), and reaches an upper position Pa1. In addition, the side-end aligning plate 55 rotationally moves counterclockwise, so that the side-end aligning plate 55 moves downward (see a broken arrow), and reaches a lower position Pa2. The pair of side-end aligning plates 55 is switched from the upper position Pa1 to the lower position Pa2 at a timing at which paper P is ejected from the second paper ejecting roller 51. Then, the pair of side-end aligning plates 55 is switched from the lower position Pa2 to the upper position Pa1 (an aligning plate rotational movement operation)

An operation of the pair of the side-end aligning plates 55 and stated another way, the paper alignment operation and the aligning plate rotational movement operation, are controlled by the paper processing controller 70.

Figure 4A:
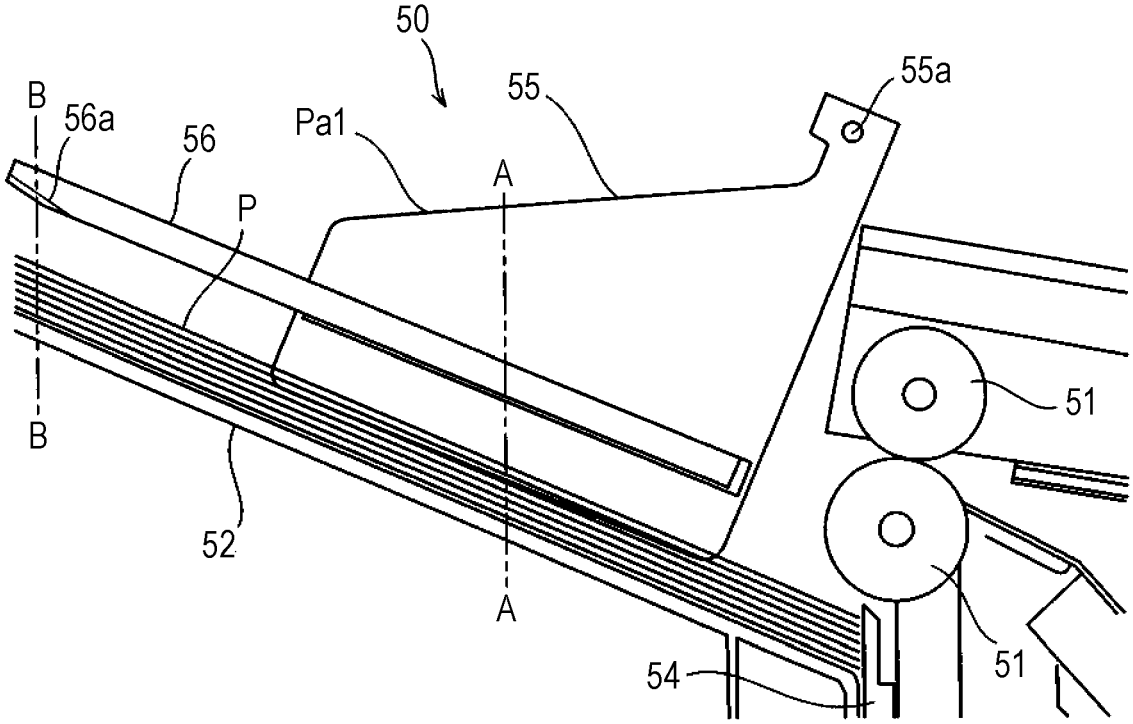
FIGS. 4A and 4B are explanatory diagrams illustrating a paper floating member from a side of paper.
Figure 4B:
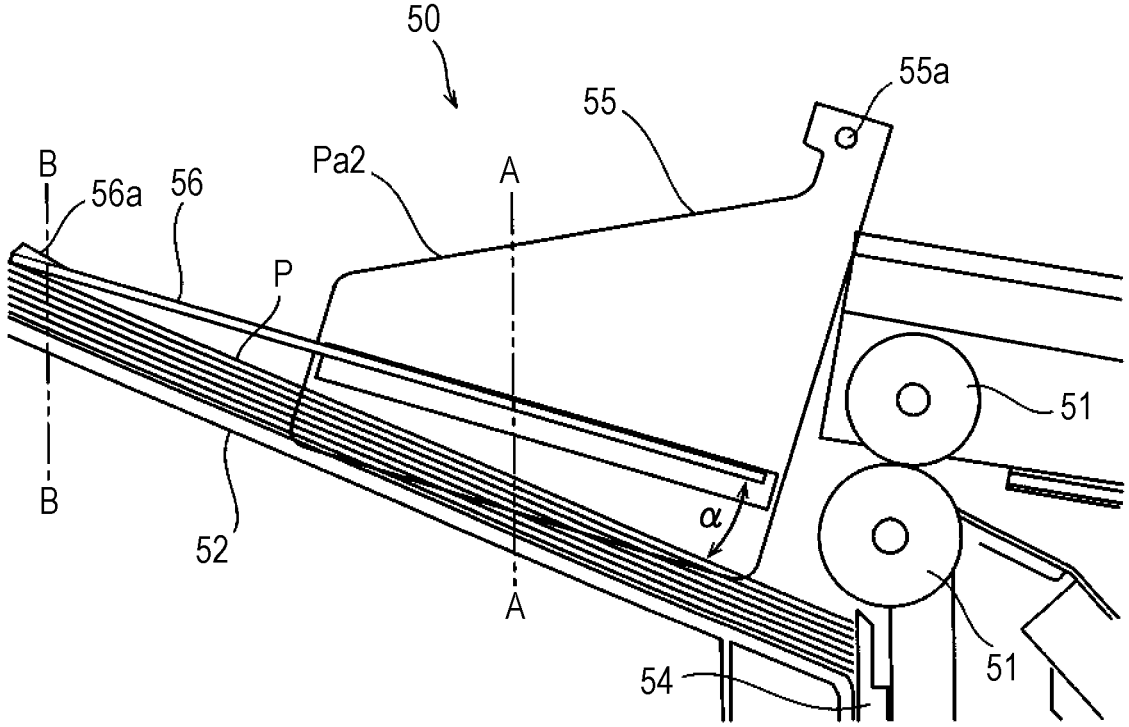
Figure 5A:
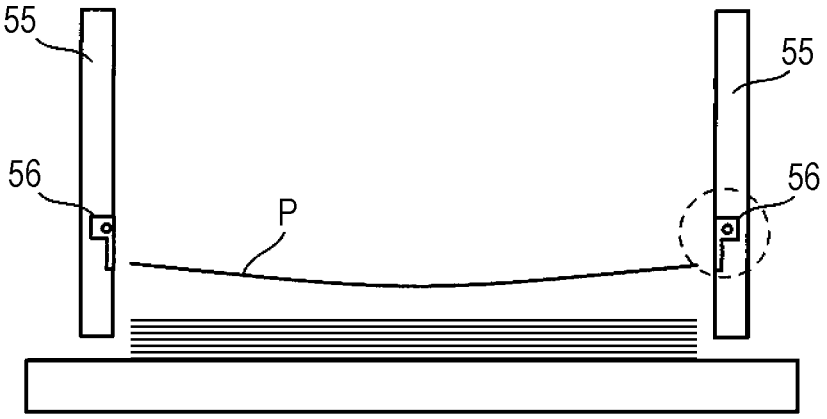
FIGS. 5A to 5C are explanatory diagrams illustrating a sectional state of the paper floating member illustrated in FIG. 4A.
Figure 5B:
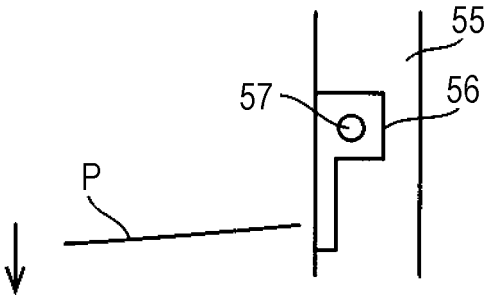
Figure 5C:
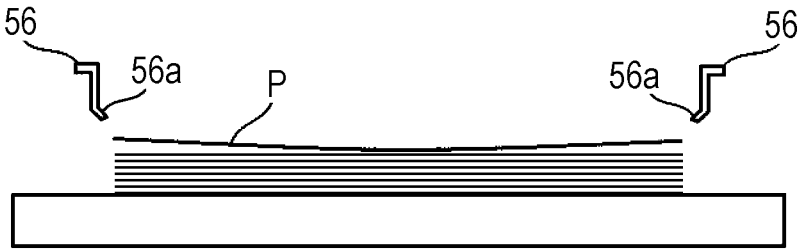
Figure 6A:
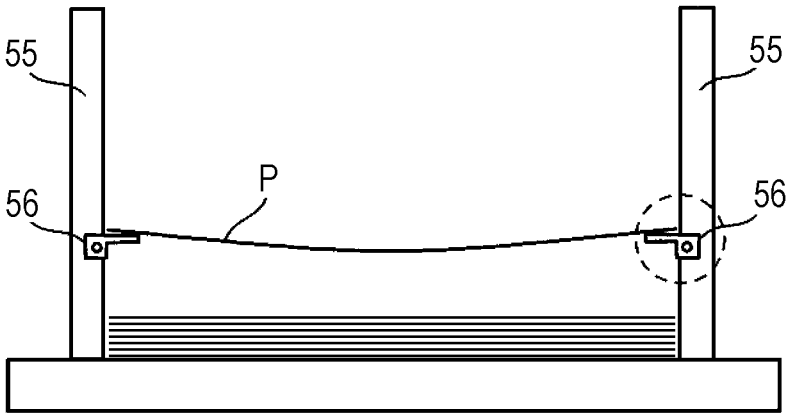
FIGS. 6A to 6C are explanatory diagrams illustrating a sectional state of the paper floating member illustrated in FIG. 4B.
Figure 6B:
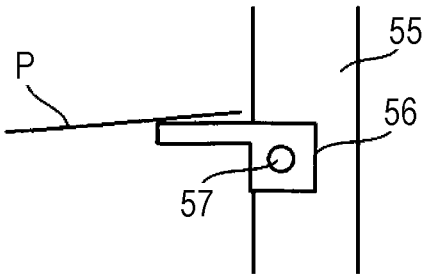
Figure 6C:
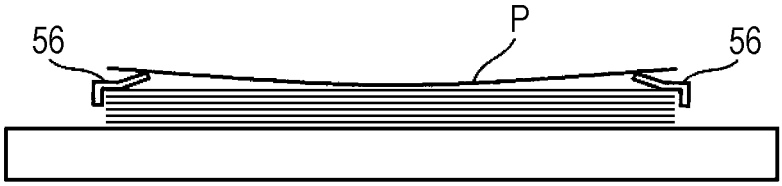

A configuration of the paper floating member 56 is described with reference to FIGS. 4A to 6C. Here, FIGS. 4A and 4B are explanatory diagrams illustrating the paper floating member 56 from a side of paper P. FIG. 4A illustrates the paper floating member 56 that is located in the retreat position. FIG. 4B illustrates the paper floating member 56 that is located in the paper floating position. FIGS. 5A to 5C are explanatory diagrams illustrating a sectional state of the paper floating member 56 illustrated in FIG. 4A. FIG. 5A illustrates AA section. FIG. 5B illustrates an enlarged view of an area surrounded with a broken line in FIG. 5A. FIG. 5C illustrates BB section. FIGS. 6A to 6C are explanatory diagrams illustrating a sectional state of the paper floating member 56 illustrated in FIG. 4B. FIG. 6A illustrates AA section. FIG. 6B illustrates an enlarged view of an area surrounded with a broken line in FIG. 6A. FIG. 6C illustrates BB section.

The paper floating member 56 is a member that supports, from below, a side end of paper P ejected from the second paper ejecting roller 51. The paper floating member 56 includes a plate shape member that extends along the paper ejection direction. The paper floating member 56 is provided in each of the pair of side-end aligning plates 55. Both side ends of paper P ejected from the second paper ejecting roller 51 are supported from below by the pair of paper floating members 56.

An individual paper floating member 56 is coupled to a shaft member 57 that extends in the paper ejection direction, and can rotationally move with this shaft member 57 as a center. The individual paper floating member 56 rotationally moves with the shaft member 57 as a center so as to be able to move between a retreat position and a paper floating position.

The retreat position is a position that retreats from the ejection route R4 of paper P and does not interfere with paper P ejected from the second paper ejecting roller 51. An example of the retreat position is a state where the paper floating member 56 is housed along the side-end aligning plate 55 so as to be almost flush with the side-end aligning plate 55. In addition, this retreat position is equivalent to a home position of the paper floating member 56.

The paper floating position is a position that advances to the ejection route R4 of paper P and causes paper P ejected from the second paper ejecting roller 51 to float from uppermost paper P stacked on the ejected paper tray 52. An example of the paper floating position is a state where the paper floating member 56 has risen from the retreat position so as to be approximately perpendicular to the side-end aligning plate 55.

In the present embodiment, the paper floating member 56 is switched between the paper floating position and the retreat position in conjunction with the movement in upward and downward directions of the side-end aligning plate 55. Specifically, when the side-end aligning plate 55 moves downward from the upper position Pa1, the paper floating member 56 attached to the side-end aligning plate 55 also moves downward. When the side-end aligning plate 55 reaches the lower position Pa2, a front end of the paper floating member 56 is pressed against uppermost paper P stacked on the ejected paper tray 52. By doing this, the paper floating member 56 receives a reaction from the paper P, and therefore the paper floating member 56 rises from the retreat position, and moves to the paper floating position.

Note that a folded part 56*a* is formed at the front end of the paper floating member 56. In the retreat position, the paper floating member 56 is almost flush with the side-end aligning plate 55, but the folded part 56*a* enables the front end of the paper floating member 56 to appropriately abut onto uppermost paper P stacked on the ejected paper tray 52.

In a case where the paper floating member 56 is located in the paper floating position, the paper floating member 56 has a prescribed opening angle $\alpha$ with respect to uppermost paper P stacked on the ejected paper tray 52.

In contrast, when the side-end aligning plate 55 moves upward from the lower position Pa2, the paper floating member 56 attached to the side-end aligning plate 55 also moves upward. By doing this, the front end of the paper floating member 56 is separated from the uppermost paper P. By doing this, the reaction from the paper P is eliminated, and therefore the paper floating member 56 moves from the paper floating position to the retreat position. The side-end aligning plate 55 moves to the upper position Pa1.

Note that biasing force is applied to the paper floating member 56 by a biasing unit (not illustrated) such as a spring. When the reaction from paper P is eliminated, the paper floating member 56 automatically moves from the paper floating position to the retreat position due to this biasing force. The paper floating member 56 may move from the paper floating position to the retreat position due to its own weight without being provided with such a biasing unit.

In addition, the folded part 56*a* is formed at the front end of the paper floating member 56. Therefore, even when the paper floating member 56 is located in the retreat position, the paper floating member 56 has a state where the folded part 56*a* protrudes from the side-end aligning plate 55. Therefore, when the side-end aligning plate 55 is moved from the lower position Pa2 to the upper position Pa1, the side-end aligning plate 55 is moved to an outer side in the paper width direction so as to be separated from a side end of paper P. This can suppress interference between the folded part 56*a* and the paper P. When the side-end aligning plate 55 is moved from the upper position Pa1 to the lower position Pa2, it is requested that the side-end aligning plate 55 be moved to an inner side in the paper width direction.

The paper processing controller 70 performs control relating to the postprocessing apparatus 2. As the paper processing controller 70, a microcomputer that principally includes a CPU, a ROM, a RAM, and an I/O interface can be used. The CPU executes various programs (a processor). The ROM stores the various programs to be executed by the CPU in the form of a program code that can be read by the CPU. The ROM also stores data that is used to execute the programs. The RAM is a memory serving as a working storage area. When the programs and the data that have been stored in the ROM are read by the CPU, the programs and the data are developed on the RAM. Then, the CPU performs various types of processing on the basis of the programs and the data that have been developed on the RAM.

In a relationship with the present embodiment, the paper processing controller 70 controls an operation of the paper floating members 56 and specifically, a paper floating operation. The paper floating operation is a series of operations to displace the paper floating members 56 from the retreat position to the paper floating position and then, to return the paper floating members 56 from the paper floating position to the retreat position. The paper floating operation is performed according to a timing at which paper P is ejected from the second paper ejecting roller 51. In the present embodiment, the paper floating operation is performed by the pair of side-end aligning plates 55 performing the aligning plate rotational movement operation.

On the conveyance route of paper P, a paper ejection sensor 21 is disposed that detects a timing at which paper P is ejected by the second paper ejecting roller 51. For example, the paper ejection sensor 21 is disposed near the second paper ejecting roller 51 on the conveyance route of paper P. For example, as the paper ejection sensor 21, a photosensor that is switched between ON and OFF according to the presence/absence of paper P can be used. Specifically, the paper ejection sensor 21 outputs ON while paper P is passing through the paper ejection sensor 21, and the paper ejection sensor 21 outputs OFF in the case of the absence of paper P. A detection result of the paper ejection sensor 21 is output to the paper processing controller 70.

Figure 7:
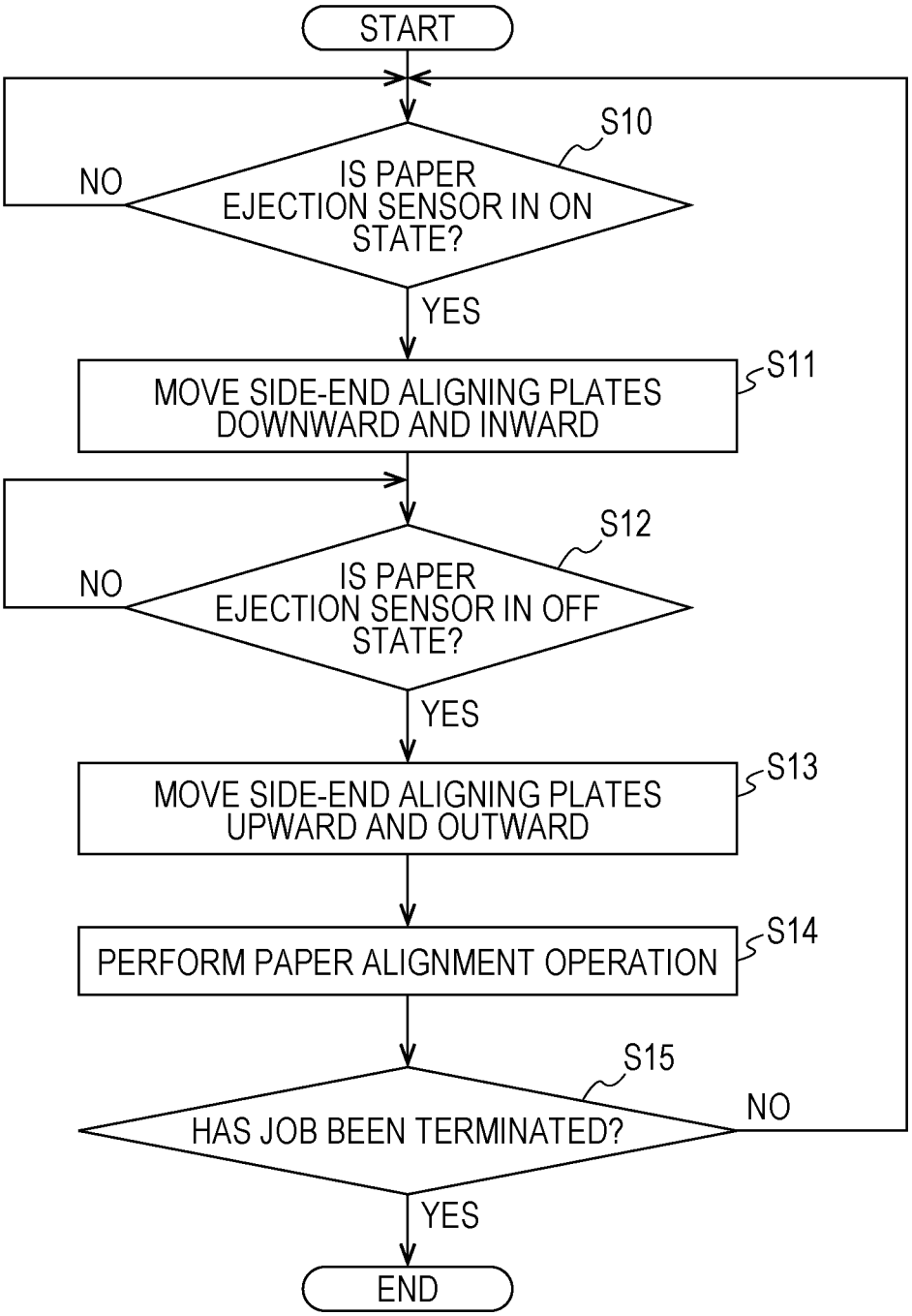
FIG. 7 is a flowchart illustrating an operation of a paper stacking device according to the first embodiment.

FIG. 7 is a flowchart illustrating an operation of the paper stacking device 50 according to the present embodiment.

Processing illustrated in this flowchart is performed by the paper processing controller 70 by using the execution of a job as a trigger. Before the execution of the job, the pair of side-end aligning plates 55 has been set to be located in the upper position Pa1. Accordingly, the paper floating members 56 have also been set to be located in the retreat position (a home position).

First, in step S10, the paper processing controller 70 refers to the paper ejection sensor 21, and determines whether the paper ejection sensor 21 is in an ON state. When a front end of paper P reaches the second paper ejecting roller 51, an output of the paper ejection sensor 21 is switched to ON. Accordingly, a timing at winch the ejection of paper P from the second paper ejecting roller 51 is started can be determined on the basis of the state of the paper ejection sensor 21. In a case where the paper ejection sensor 21 is in the ON state, and stated another way, in a case where the ejection of paper P from the second paper ejecting roller 51 is started, the determination of step S10 is affirmative, and the processing moves on to step S11. In contrast, in a case where the paper ejection sensor 21 is in an OFF state, and stated another way, in a case where paper P is not ejected from the second paper ejecting roller 51, the determination of step S10 is negative, and the processing returns to step S10.

In step S11, the paper processing controller 70 moves the side-end aligning plates 55 downward from the upper position Pa1 to the lower position Pa2. The paper processing controller 70 also moves the side-end aligning plates 55 inward in such a way that the side-end aligning plates 55 are closer to side ends of paper P.

When the side-end aligning plates 55 move downward and inward, the paper floating members 56 attached to the side-end aligning plates 55 also move downward and inward. When the side-end aligning plates 55 reach the lower position Pa2, the folded parts 56*a* of the paper floating members 56 are pressed against uppermost paper P stacked on the ejected paper tray 52. A reaction from the paper P acts on the paper floating members 56, and therefore the paper floating members 56 rise from the retreat position, and move to the paper floating position. When the paper floating members 56 move to the paper floating position, both side ends of paper P ejected from the second paper ejecting roller 51 are respectively supported by the pair of paper floating members 56. Therefore, the paper P is ejected in a state where the paper P is floating from uppermost paper P stacked on the ejected paper tray 52.

In step S12, the paper processing controller 70 refers to the paper ejection sensor 21, and determines whether the paper ejection sensor 21 is in the OFF state. When a rear end of paper P passes through the second paper ejecting roller 51, an output of the paper ejection sensor 21 is switched to OFF. Accordingly, a timing at which the ejection of paper P from the second paper ejecting roller 51 has been terminated can be determined on the basis of the state of the paper ejection sensor 21. In a case where the paper ejection sensor 21 is in the OFF state, and stated another way, in a case where the ejection of paper P from the second paper ejecting roller 51 has been terminated, the determination of step S12 is affirmative, and the processing moves on to step S13. In contrast, in a case where the paper ejection sensor 21 is in the ON state, and stated another way, in a case where paper P continues being ejected from the second paper ejecting roller 51, the determination of step S12 is negative, and the processing returns to step S12.

In step S13, the paper processing controller 70 moves the side-end aligning plates 55 upward from the lower position Pa2 to the upper position Pa1. The paper processing controller 70 also moves the side-end aligning plates 55 outward in such a way that the side-end aligning plates 55 are separated from side ends of paper P.

When the side-end aligning plates 55 move upward and outward, the paper floating members 56 attached to the side-end aligning plates 55 also move upward and outward. By doing this, the front ends of the paper floating members 56 are separated from the uppermost paper P. By doing this, the reaction from the paper P is eliminated, and therefore the paper floating members 56 move from the paper floating position to the retreat position. When the paper floating members 56 move to the retreat position, the paper floating members 56 retreat from the ejection route R4 of paper P ejected from the second paper ejecting roller 51. Therefore, the paper P drops due to its own weight, and is stacked as uppermost paper P on the ejected paper tray 52.

In step S14, the paper processing controller 70 causes the side-end aligning plates 55 to operate, and performs a paper alignment operation.

In step S15, the paper processing controller 70 determines whether paper P ejected from the second paper ejecting roller 51 is absent, and stated another way, whether the jog has been terminated. In a case where the job has not been terminated and there is paper P ejected from the second paper ejecting roller 51, the determination of step S15 is negative, and the processing returns to step S10. In contrast, in a case where the job has been terminated and there is no paper P ejected from the second paper ejecting roller 51, the determination of step S15 is affirmative, and this routine is terminated.

As described above, in the present embodiment, the paper stacking device 50 includes: the ejected paper tray 52 on which paper P is stacked; the second paper ejecting roller 51 that ejects paper P toward the ejected paper tray 52; the side-end aligning plates 55 that are disposed on sides of paper P stacked on the ejected paper tray 52 and align side ends of the paper P; and the paper floating members 56 that are provided in the side-end aligning plates 55 and support, from below, side ends of paper P ejected from the second paper ejecting roller 51. In this case, the paper floating members 56 are switched between the paper floating position and the retreat position in conjunction with the movement in upward and downward directions of the side-end aligning plates 55.

By employing this configuration, the paper floating members 56 are set to be located in the paper floating position, and therefore the side ends of paper P are supported from below by the paper floating members 56. This enables the paper P to be ejected while the paper P is floating. This can suppress the occurrence of sticking onto uppermost paper P. In addition, the side ends of paper P are supported from sides of the paper P, and therefore the paper floating members 56 do not need to be set to have a large size in the paper width direction. This does not cause a reduction in productivity. In addition, the paper floating members 56 can secure a sufficient length in the paper ejection direction, and this can appropriately suppress sticking onto uppermost paper P.

In addition, the paper floating position and the retreat position can be switched in conjunction with the movement of the side-end aligning plates 55. Therefore, a dedicated power mechanism for causing the paper floating member 56 to operate can be omitted, and this can suppress the complication of a device configuration.

In addition, in the present embodiment, the side-end aligning plates 55 move downward, and are pressed against paper P stacked on the ejected paper tray 52. Therefore, the paper floating members 56 receive a reaction from the paper P, and move from the retreat position to the paper floating position. Further, the side-end aligning plates 55 move upward, and are separated from paper P stacked on the ejected paper tray 52. Therefore, the paper floating members 56 move from the paper floating position to the retreat position.

By employing this configuration, the paper floating position and the retreat position can be appropriately switched in conjunction with the movement of the side-end aligning plates 55.

Furthermore, in the present embodiment, at a timing at which paper P is ejected from the second paper ejecting roller 51, the paper floating members 56 are switched from the retreat position to the paper floating position, and then the paper floating members 56 are switched from the paper floating position to the retreat position.

By employing this configuration, the paper floating members 56 can be caused to operate in accordance with a timing of the ejection of paper P. This enables paper P to float or drop onto the ejected paper tray 52 at an appropriate timing. As a result, the sticking of paper P can be suppressed, and a reduction in productivity can also be suppressed.

In addition, in the present embodiment, the side-end aligning plates 55 rotationally move by using, as a center, the rotary shaft 55*a* that is orthogonal to the paper ejection direction in which paper P is ejected from the second paper ejecting roller 51 so as to move in upward and downward directions.

By employing this configuration, the movement in upward and downward directions of the side-end aligning plates 55 that causes the switching of the paper floating members 56 can be appropriately performed.

In the present embodiment, in a case where the paper floating member 56 is located in the paper floating position, the paper floating member 56 has a prescribed opening angle α with respect to uppermost paper P stacked on the ejected paper tray 52.

By employing this configuration a space that causes paper P to float can be secured between uppermost paper P stacked on the ejected paper tray 52 and paper P supported by the paper floating members 56. As a result, paper P to be ejected can be ejected while floating from uppermost paper P, and this can suppress the occurrence of sticking onto the uppermost paper P.

Second Embodiment

An image forming system according to a second embodiment is described below. The image forming system according to the second embodiment is different from the image forming system according to the first embodiment in that the paper floating member 56 has a plurality of paper floating positions that have different opening angles α. A difference from the first embodiment is principally described below.

Figure 8A:
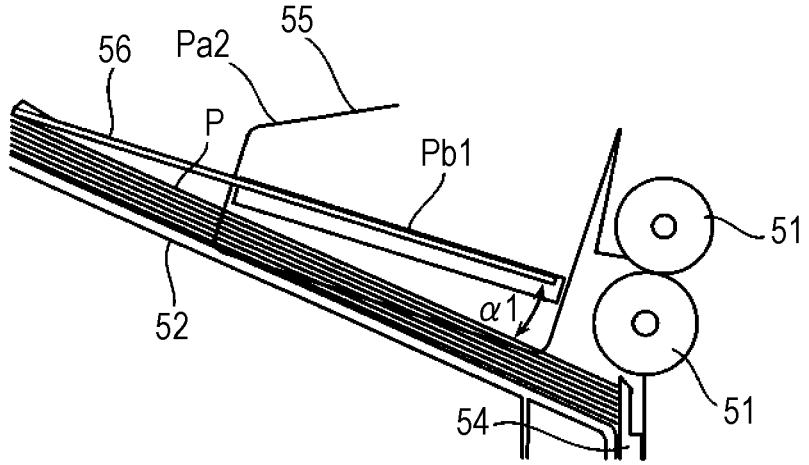
FIGS. 8A to 8C are explanatory diagrams exemplifying three paper floating positions.
Figure 8B:
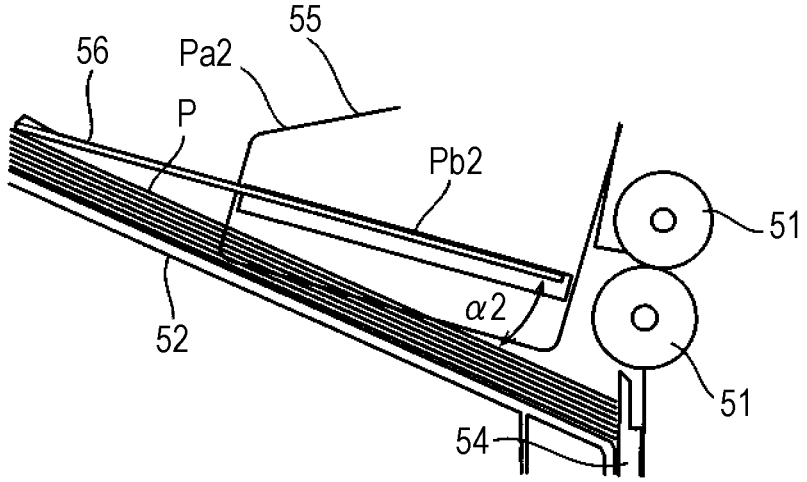
Figure 8C:
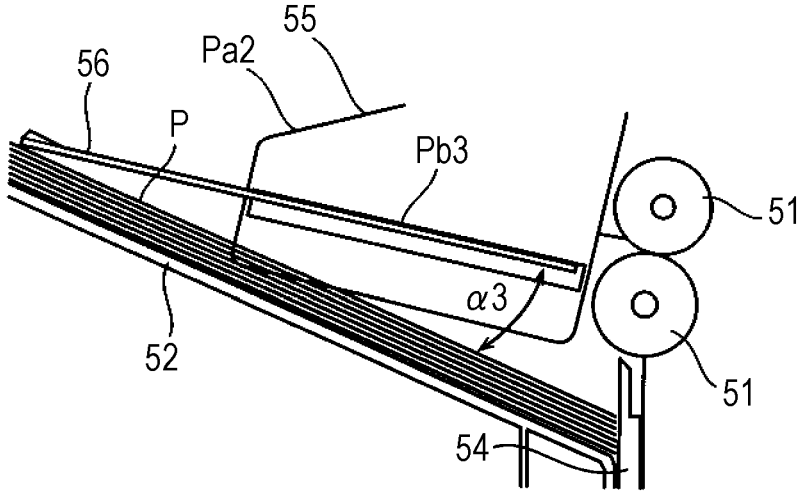

FIGS. 8A to 8C are explanatory diagrams exemplifying three paper floating positions Pb1 to Pb3. The paper floating position Pb3 is a position having an opening angle α3 serving as the largest angle, and the paper floating position Pb1 is a position having an opening angle α1 serving as the smallest angle. The paper floating position Pb2 is a position having an opening angle α2 serving as an angle that is intermediate between the opening angle α3 and the opening angle α1.

The opening angles α1, α2, and α3 can be adjusted by shifting the position of uppermost paper P stacked on the ejected paper tray 52 and the lower position Pa2 of the side-end aligning plates 55 in a relatively downward direction. Specifically, as the position of the ejected paper tray 52 (uppermost paper P) and the lower position Pa2 of the side-end aligning plates 55 shift in a more downward direction, the opening angle α increases.

In this case, the paper processing controller 70 can switch the three paper floating positions Pb1 to Pb3 on the basis of information relating to paper P to be ejected from the second paper ejecting roller 51. Examples of the information relating to paper P include the basis weight of paper P, the size of paper P, and image information printed on paper P.

FIG. 9 is an explanatory diagram illustrating a relationship between information relating to paper P and a paper floating position. The basis weight of paper P is handled below at three levels, large, medium, and small. In a case where paper P has a large basis weight, the paper P tends to be easily deflected due to its own weight. Therefore, sticking onto uppermost paper P easily occurs. Accordingly, by selecting the paper floating position Pb3 having the opening angle α3 serving as the largest angle, a large space can be secured between uppermost paper P and paper P supported by the paper floating members 56. On the other hand, in a case where paper P has a large basis weight, the paper P has a high dropping speed. Therefore, even if the paper floating position Pb3 is selected, a reduction in productivity is small. Accordingly, in a case where paper P has a large basis weight, the paper floating position Pb3 is used.

In contrast, in a case where paper P has a small basis weight, the paper P has a slow dropping speed. Accordingly, by selecting the paper floating position Pb1 having the opening angle α1 serving as the smallest angle, a space between uppermost paper P and paper P supported by the paper floating members 56 can be narrowed. In a case where paper P has a small basis weight, the deflection of the paper P is small. Therefore, even if the paper floating position Pb1 is selected, an influence of sticking onto uppermost paper P is small. Accordingly, in a case where paper P has a small basis weight, the paper floating position Pb1 having the opening angle α1 serving as the smallest angle is used.

In a case where paper P has a medium basis weight, the paper floating position Pb2 having the opening angle α2 serving as an intermediate angle is used in consideration of both the sticking of paper P and productivity.

A similar manner of thinking is applied to the size of paper P and image information printed on paper P. Stated another way, in a case where paper P has a large size, the paper floating position Pb3 is used. In a case where paper P has a medium size, the paper floating position Pb2 is used. In a case where paper P has a small size, the paper floating position Pb1 is used. In addition, in a case where paper P has a large amount of image information, the paper floating position Pb3 is used. In a case where paper P has a medium amount of image information, the paper floating position Pb2 is used. In a case where paper P has a small amount of image information, the paper floating position Pb1 is selected.

Further, instead of switching the paper floating position in multiple stages, the paper processing controller 70 may determine whether to perform a paper floating operation on the basis of information relating to paper P to be ejected from the second paper ejecting roller 51.

Furthermore, in the present embodiment, a method for switching the paper floating position and the retreat position by rotationally moving the paper floating members 56 has been described. However, the operation mode of the paper floating members 56 is not limited to this, if the paper floating members 56 operate in conjunction with the movement in upward and downward directions of the side-end aligning plates 55. For example, the paper floating members 56 may retreat in a horizontal direction so that the paper floating position and the retreat position are switched.

An image forming system and a paper stacking device according to an embodiment of the present invention have been described above. However the present invention is not limited to the embodiments described above, and a variety of variations can be made without departing from the scope of the invention.

For example, in the present embodiments, the image forming system includes an image forming apparatus that has an image forming function and a paper processing apparatus that performs processing on paper. However, the paper stacking device may be applied to an isolated paper processing apparatus that is independent of the image forming system, or the paper stacking device may be applied to an isolated image forming apparatus that is independent of the image forming system.

In addition, in the present embodiments, the paper processing apparatus includes a dedicated controller, and the controller controls the paper stacking device. However, the paper stacking device may include a dedicated controller. Further, in a case where the paper processing apparatus is combined with the image forming apparatus, a controller that controls the image forming apparatus may control the paper stacking device.

Although embodiments of the present invention have been described and illustrated in detail, the disclosed embodiments are made for purposes of illustration and example only and not limitation. The scope of the present invention should be interpreted by terms of the appended claims.

What is claimed is:

1. A paper stacking device comprising:

a stacker on which paper is stacked;

a paper ejector that ejects the paper toward the stacker;

an aligning plate that is provided on a side of the paper stacked on the stacker, and aligns a side end of the paper; and a paper floating member that is provided in the aligning plate, and supports, from below, the side end of the paper ejected from the paper ejector, wherein the paper floating member is switched, in conjunction with a movement in upward and downward directions of the aligning plate, between:

a paper floating position that advances from a side of the side end of the paper to an ejection route of the paper, and causes the paper ejected from the paper ejector to float from an uppermost paper stacked on the stacker;

a retreat position that retreats from the ejection route; and wherein:

the paper ejector ejects the paper toward the stacker in a direction; and the side end of the paper extends in a direction parallel to the direction.

2. The paper stacking device according to claim 1, wherein, at a timing at which the paper is ejected from the paper ejector, the paper floating member is switched from the retreat position to the paper floating position, and then, the paper floating member is switched from the paper floating position to the retreat position.

3. The paper stacking device according to claim 1, wherein by rotationally moving with a rotary shaft as a center, the aligning plate moves in the upward and downward directions, the rotary shaft being orthogonal to a paper ejection direction in which the paper is ejected from the paper ejector.

4. The paper stacking device according to claim 3, wherein whether to perform an operation to switch the paper floating position and the retreat position can be selected in accordance with information relating to the paper to be ejected from the paper ejector.

5. An image forming system comprising:

an image forming apparatus that forms an image on paper; and a paper processing apparatus that performs processing on the paper that has been fed from the image forming apparatus, wherein the paper processing apparatus includes the paper stacking device according to claim 1 to which the paper on which the processing has been performed is ejected.

6. A paper stacking device comprising:

a stacker on which paper is stacked;

a paper ejector that ejects the paper toward the stacker;

an aligning plate that is provided on a side of the paper stacked on the stacker, and aligns a side end of the paper; and a paper floating member that is provided in the aligning plate, and supports, from below, the side end of the paper ejected from the paper ejector, wherein the paper floating member is switched, in conjunction with a movement in upward and downward directions of the aligning plate, between:

a paper floating position that advances from a side of the side end of the paper to an ejection route of the paper, and causes the paper ejected from the paper ejector to float from an uppermost paper stacked on the stacker; and a retreat position that retreats from the ejection route;

wherein the paper floating member, by being pressed against the paper stacked on the stacker according to a downward movement of the aligning plate, receives a reaction from the paper and moves from the retreat position to the paper floating position, and by being separated from the paper stacked on the stacker according to an upward movement of the aligning plate, moves from the paper floating position to the retreat position.

7. A paper stacking device comprising:

a stacker on which paper is stacked;

a paper ejector that ejects the paper toward the stacker;

an aligning plate that is provided on a side of the paper stacked on the stacker, and aligns a side end of the paper; and a paper floating member that is provided in the aligning plate, and supports, from below, the side end of the paper ejected from the paper ejector, wherein the paper floating member is switched, in conjunction with a movement in upward and downward directions of the aligning plate, between:

a paper floating position that advances from a side of the side end of the paper to an ejection route of the paper, and causes the paper ejected from the paper ejector to float from an uppermost paper stacked on the stacker; and a retreat position that retreats from the ejection route;

wherein, in a case where the paper floating member is located in the paper floating position, the paper floating member has a prescribed opening angle with respect to the uppermost paper stacked on the stacker; and wherein the paper floating member has a plurality of paper floating positions that have the different opening angles.

8. The paper stacking device according to claim 7, further comprising a hardware processor that switches the plurality of paper floating positions on the basis of information relating to the paper to be ejected from the paper ejector.

* * * * *